US010173871B2

(12) United States Patent
Hallen et al.

(10) Patent No.: US 10,173,871 B2
(45) Date of Patent: Jan. 8, 2019

(54) WINCH HOIST PULL PIN HANDLE

(71) Applicant: Lincoln Precision Machining Company, North Grafton, MA (US)

(72) Inventors: David B. Hallen, Rutland, MA (US); Richard A. Perduta, Grafton, MA (US)

(73) Assignee: Lincoln Precision Machining Company, North Grafton, MA (US)

( * ) Notice: Subject to any disclaimer, the term of this patent is extended or adjusted under 35 U.S.C. 154(b) by 29 days.

(21) Appl. No.: 15/361,718

(22) Filed: Nov. 28, 2016

(65) Prior Publication Data

US 2017/0152127 A1 Jun. 1, 2017

Related U.S. Application Data

(60) Provisional application No. 62/260,796, filed on Nov. 30, 2015.

(51) Int. Cl.
*B66D 3/00* (2006.01)
*B66D 3/14* (2006.01)

(52) U.S. Cl.
CPC ..... *B66D 3/14* (2013.01)

(58) Field of Classification Search
CPC ..... B66D 3/14; B66D 2700/0116
See application file for complete search history.

(56) References Cited

U.S. PATENT DOCUMENTS 2,670,176 A * 2/1954 Coffing ..... B66D 3/14 254/369
3,056,480 A * 10/1962 Carroll ..... B66D 3/14 192/16
3,245,660 A * 4/1966 Ratcliff ..... B66D 3/14 254/369
3,279,760 A * 10/1966 Bathum, Jr. ..... B66D 3/14 254/376
3,547,407 A * 12/1970 Ratcliff ..... B66D 3/14 254/376
3,648,978 A * 3/1972 Ratcliff ..... B66D 3/14 242/157 R
3,727,886 A * 4/1973 Cain ..... B66D 3/14 254/369
3,741,528 A * 6/1973 Profet ..... B66D 3/14 254/333
3,796,448 A * 3/1974 Ringkamp ..... E21B 17/046 175/323
4,218,046 A * 8/1980 Bathum, Jr. ..... B66D 1/58 254/266
4,251,060 A * 2/1981 Suzuki ..... B66D 3/14 192/16
4,420,144 A * 12/1983 Nishimura ..... B66D 3/14 254/345
5,344,121 A * 9/1994 Baziuk ..... B66D 3/14 254/358

(Continued)

*Primary Examiner* — Emmanuel M Marcelo
(74) *Attorney, Agent, or Firm* — Brian M. Dingman; Dingman IP Law, PC

(57) ABSTRACT

A handle-engaging assembly for releasably engaging a winch hoist handle in a winch hoist, where the winch hoist comprises a frame with an integral handle-receiving socket that is adapted to receive the handle. There is a pull pin assembly that comprises a spring-loaded pin that is constructed and arranged to be manipulated such that it engages with or disengages from an opening in the handle.

10 Claims, 8 Drawing Sheets

(56) References Cited

U.S. PATENT DOCUMENTS

| | | | | |
|---|---|---|---|---|
| 5,421,553 | A * | 6/1995 | Hashiue | B66D 3/14<br>254/346 |
| 6,641,116 | B1 * | 11/2003 | Huang | B60P 7/083<br>24/68 CD |
| 2002/0088091 | A1 * | 7/2002 | Grote | B05C 17/0205<br>16/429 |

* cited by examiner

WINCH HOIST PULL PIN HANDLE

CROSS-REFERENCE TO RELATED APPLICATION

This application claims priority of Provisional Application 62/260,796 filed on Nov. 30, 2015.

FIELD

This application relates to a winch hoist.

BACKGROUND

Winch hoists are known, for example as disclosed in U.S. Pat. No. 8,424,846, the disclosure of which is incorporated herein by reference. In some case, different handles are needed. There would be advantage to a winch hoist in which the handle was easily replaceable by a person using the winch hoist.

SUMMARY

Featured in this disclosure is an arrangement for releasably coupling a handle to a winch hoist. The coupling is accomplished with a pin captured in the hoist and that is adapted to engage with and disengage from the handle. A result is that the handle can be easily added to and removed from the hoist with a simple pull of the pin.

This disclosure includes a handle-engaging assembly for releasably engaging a winch hoist handle in a winch hoist, where the winch hoist comprises a frame with an integral handle-receiving socket that is adapted to receive the handle. The handle-engaging assembly includes a pull pin assembly that comprises a spring-loaded pin that is constructed and arranged to be manipulated such that it engages with or disengages from an opening in the handle.

The pull pin assembly pin may be captured within an externally threaded insert that is threaded into and captured within a threaded receptacle that is mounted in the handle socket. The pin may be aligned with the opening in the handle when the handle is properly rotationally aligned with and fully inserted into the socket. The pull pin assembly may include a cavity in which a coil spring is located, where the spring is constructed and arranged to push the pin into the opening in the handle. The assembly may further comprise a fixed projection on the handle portion that is received in the socket, and a mating receiving recess in the socket that receives the fixed projection when the handle is in proper rotational alignment and has been fully inserted into the socket. The pin may have a tapered or chamfered end. The handle may have a tapered or chamfered end.

Also featured in this disclosure is a handle-engaging assembly for releasably engaging a winch hoist handle in a winch hoist, where the winch hoist comprises a frame with an integral handle-receiving socket that is adapted to receive the handle, comprising a pull pin assembly that comprises a spring-loaded pin that is constructed and arranged to be manipulated such that it engages with or disengages from an opening in the handle, wherein the pull pin assembly pin is captured within an externally threaded insert that is threaded into and captured within a threaded receptacle that is mounted in the handle socket, the pin is aligned with the opening in the handle when the handle is properly rotationally aligned with and fully inserted into the socket, and the pull pin assembly further comprises a cavity in which a coil spring is located, where the spring is constructed and arranged to push the pin into the opening in the handle.

The assembly may further comprise a fixed projection on the handle portion that is received in the socket, and a mating receiving recess in the socket that receives the fixed projection when the handle is in proper rotational alignment and has been fully inserted into the socket. The pin and the handle may each have a tapered or chamfered end.

Further featured in this disclosure is a handle-engaging assembly for releasably engaging a winch hoist handle in a winch hoist, where the winch hoist comprises a frame with an integral handle-receiving socket that is adapted to receive the handle, comprising a pull pin assembly that comprises a spring-loaded pin that is constructed and arranged to be manipulated such that it engages with or disengages from an opening in the handle, wherein the pull pin assembly pin is captured within an externally threaded insert that is threaded into and captured within a threaded receptacle that is mounted in the handle socket, the pin is aligned with the opening in the handle when the handle is properly rotationally aligned with and fully inserted into the socket, the pull pin assembly further comprises a cavity in which a coil spring is located, where the spring is constructed and arranged to push the pin into the opening in the handle, the pin has a tapered or chamfered end, the handle has a tapered or chamfered end, and there is a fixed projection on the handle portion that is received in the socket, and a mating receiving recess in the socket that receives the fixed projection when the handle is in proper rotational alignment and has been fully inserted into the socket.

BRIEF DESCRIPTION OF THE DRAWINGS

Two non-limiting examples of the winch hoist pull pin-engaged handle are shown in the drawings, wherein.

DETAILED DESCRIPTION OF EXAMPLES

Figure 1:
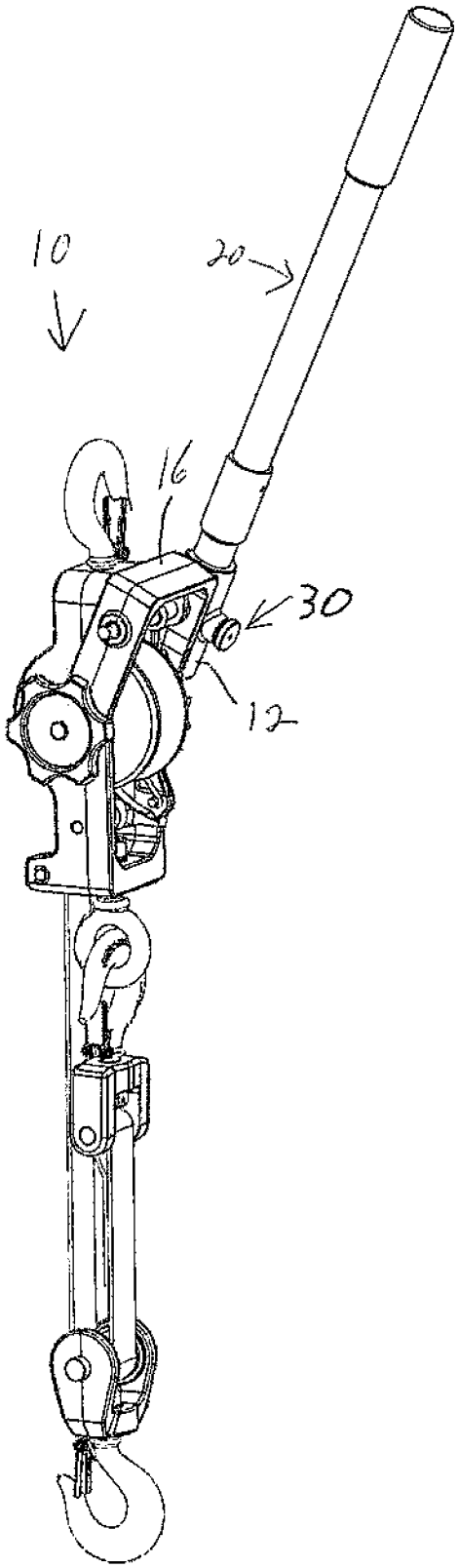
FIG. 1 is an overall view of a winch hoist with an example of the subject pull pin-engaged handle.
Figure 2:
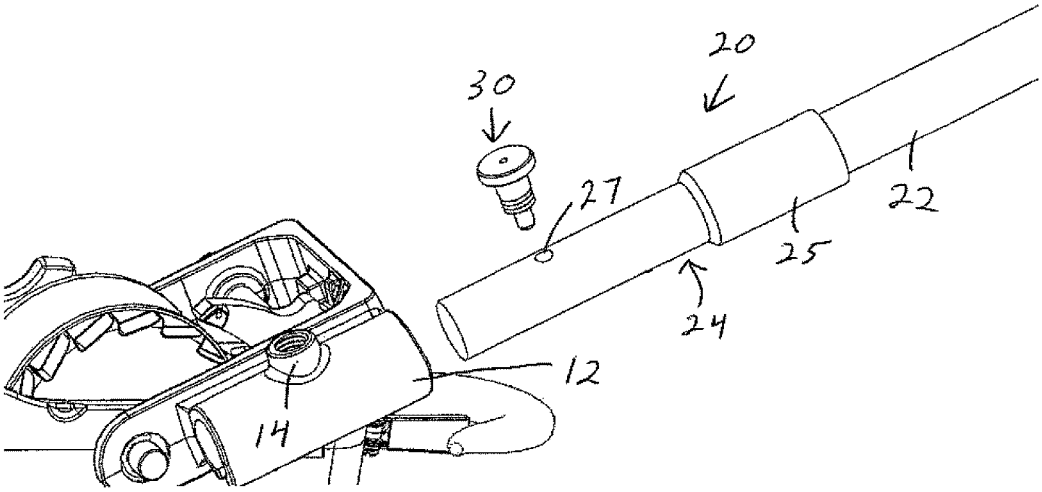
FIG. 2 is a partial exploded view thereof.
Figure 3A:
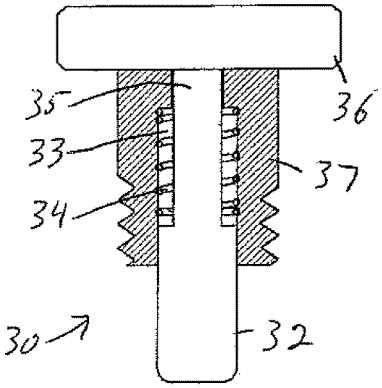
FIGS. 3A and 3B are cross-sectional views of the pin in the engaged and disengaged positions, respectively.
Figure 3B:
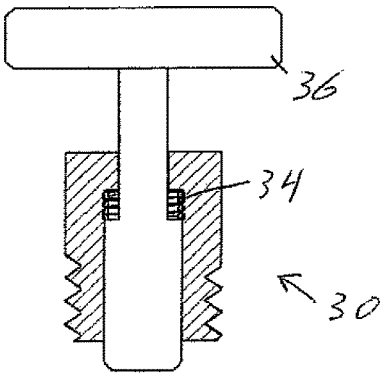

The winch hoist pull pin-engaged handle described and shown in FIGS. 1-5 is one non-limiting example of the invention. Winch hoist 10, FIG. 1, is a known type of winch hoist; details of winch hoists that are omitted herein for the sake of clarity are disclosed in U.S. Pat. No. 8,424,846, incorporated herein by reference. The present disclosure relates to an arrangement for releasably coupling a handle to a winch hoist. The coupling is accomplished with a pin captured in the hoist and that is adapted to engage with and disengage from the handle. A result is that handles can be easily added to and removed from the hoist with a simple pull of the pin.

Winch hoist 10 comprises frame 16 with integrally cast (or, separately cast and mechanically connected) handle socket 12, which is adapted to receive handle 20. Handle 20 can have a variety of shapes, sizes and constructions. The handle can be non-conductive for use around electricity, or can be conductive for other uses. In this non-limiting example, handle 20 includes fiberglass portion 22 (which can be made of other materials that do not conduct electricity, such as plastic or wood) that is coupled to metal tip portion 24. Tip portion 24 comprises socket 25 that receives handle portion 22 and holds it in place (e.g., with one or more fasteners such as screws, not shown that fit through openings 29), and distal portion 26 that fits into socket 12. The handle can be properly rotationally aligned in the socket by any convenient mechanical manner. In this case the alignment is accomplished with pin (projection) 28 in portion 26, which fits into receiving slot 13 in socket 12. See FIGS. 5A and 5B. Proper alignment could be achieved in other ways such as with mating shapes (e.g., round shapes with one flat side) and the like, as would be apparent to one skilled in the technical field.

Figure 4A:
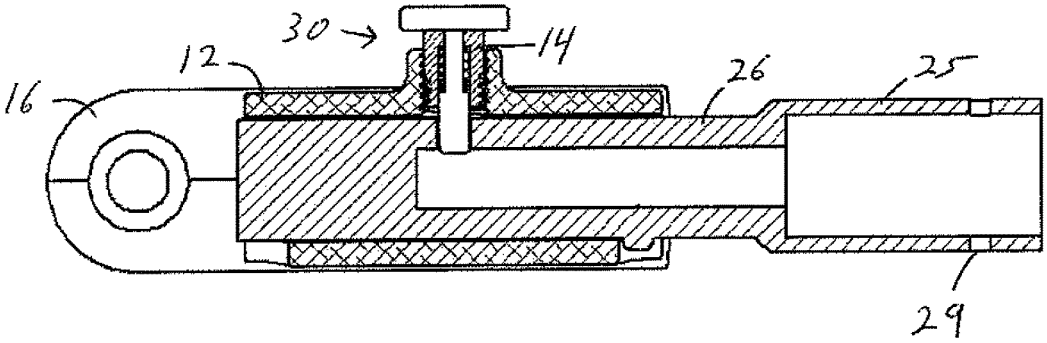
FIGS. 4A and 4B are longitudinal cross-sectional views of the socket, handle, and pin in the engaged and disengaged positions, respectively.
Figure 4B:
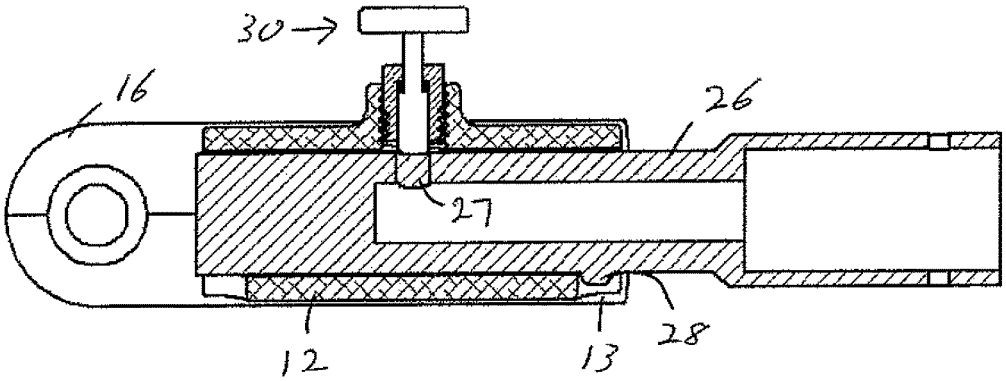
Figure 5A:
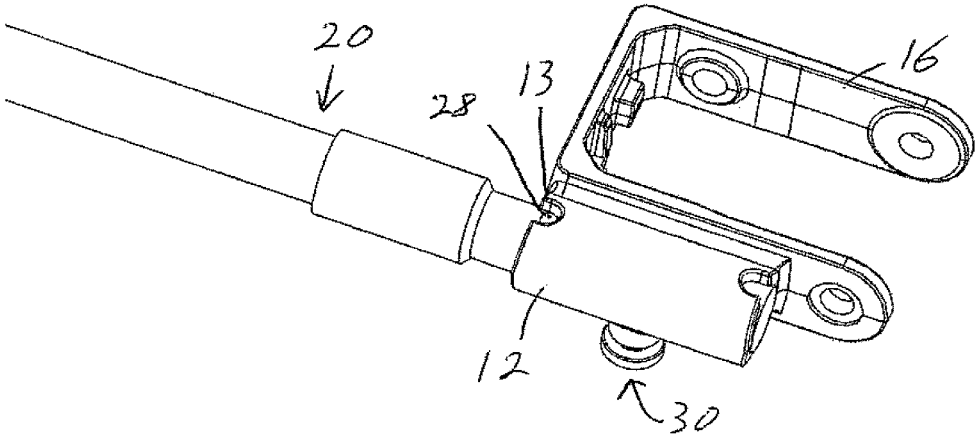
FIGS. 5A and 5B show the handle engaged with and disengaged from the socket.
Figure 5B:
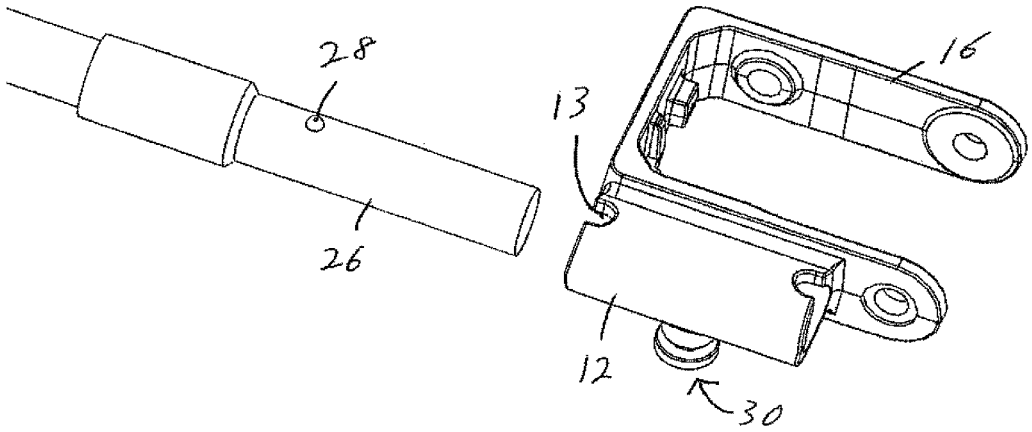
Figure 6:
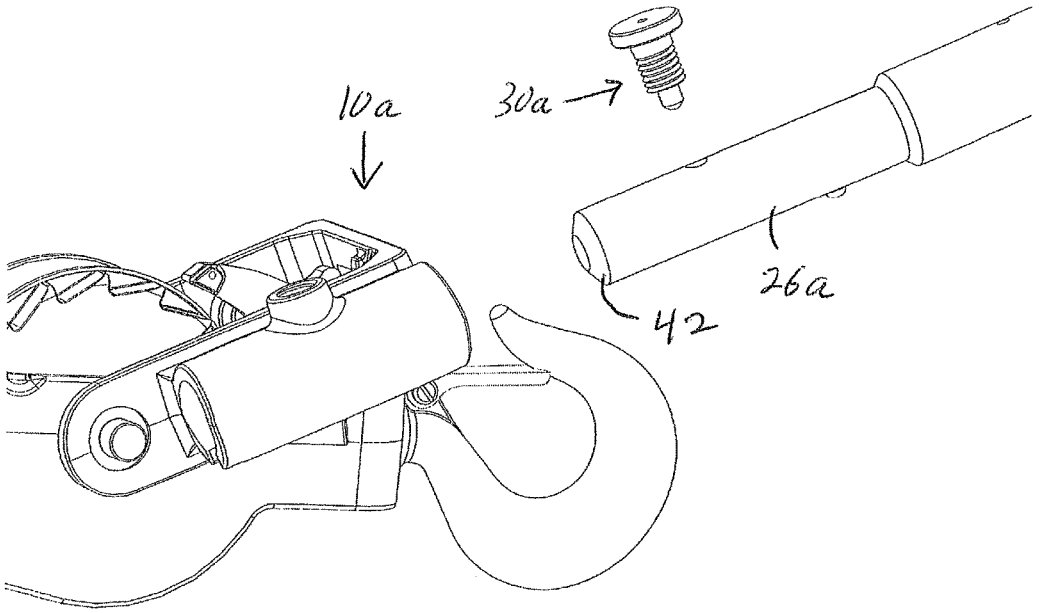
FIGS. 6, 7A, 7B, 8A and 8B are very similar to FIGS. 2, 3A, 3B, 4A and 4B, respectively, but showing a revised pull pin and pull pin-engaged handle.
Figure 7A:
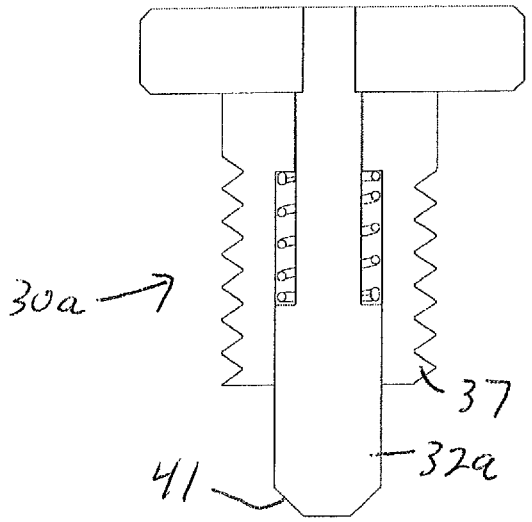
Figure 7B:
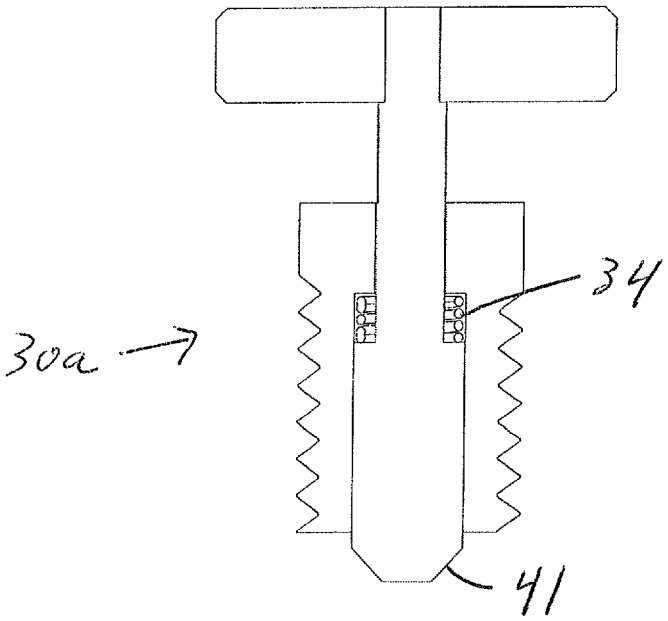
Figure 8A:
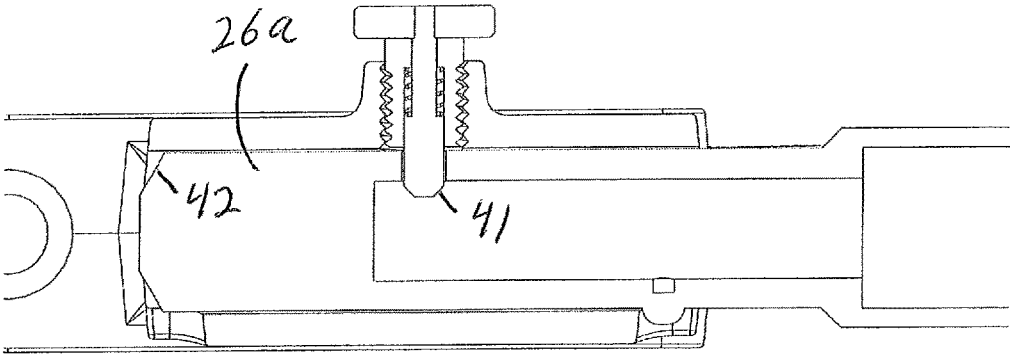
Figure 8B:
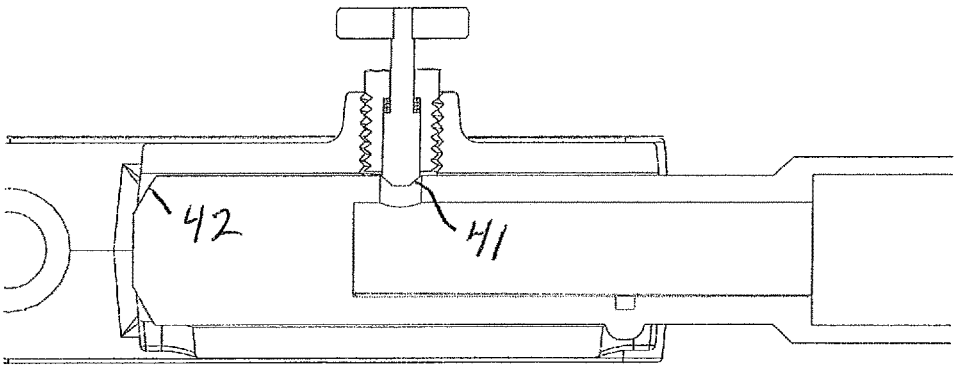

Pull pin assembly 30 includes a spring-loaded plunger or pin that can be manipulated such that it engages with or disengages from the handle. In the non-limiting example herein, spring-loaded pull pin assembly 30 comprises pin 32 that is captured within externally threaded insert 37 that is threaded into and captured within threaded receptacle 14 that is mounted in the top of socket 12, such that pin 32 will be aligned with opening 27 in handle portion 26 when the handle is properly and fully inserted into the socket. Insert 37 may include a wrench flat to facilitate proper assembly into receptacle 14. Assembly 30 includes cavity 33 in which coil spring 34 is located. Spring 34 in its relaxed state pushes pin 32 into opening 27, as shown in FIG. 4A. Enlarged member or head 36 (which can be attached to the top of pin 32 in any convenient manner, such as by welding or riveting) can be grasped by a user and pulled up so as to release pin 32 from opening 27. Handle 20 will thereby be released from socket 12 so that the handle can be removed (for any desired purpose). In the up position shown in FIGS. 3B and 4B, spring 34 is compressed. Accordingly, when member 36 is released by the user spring 34 will push pin 32 down. If opening 27 is located below the pin, the pin will enter/engage in the opening.

When a handle is being inserted into socket 12, once tip 26 is inserted far enough to extend beyond receptacle 14 the pin can be released. The distal end of the pin will ride on the outside of handle portion 26 until hole 27 is located directly beneath the pin, whereby the spring will push the pin into the opening. In order to accomplish the necessary alignment of the pin and the opening, the handle needs to be properly rotationally aligned in the socket, and the handle must be inserted far enough into the socket. Both rotational alignment and insertion depth are preferably fixed by a mechanical arrangement. The mechanical arrangement in this non-limiting example is accomplished with fixed projection 28 that projects from handle portion 26; projection 28 is similar in some ways to a detent. Receiving recess 13 in socket 12 receives projection 28 when the handle is in proper rotational alignment and has been fully inserted into the socket. See FIGS. 5A and 5B.

Figure 9A:
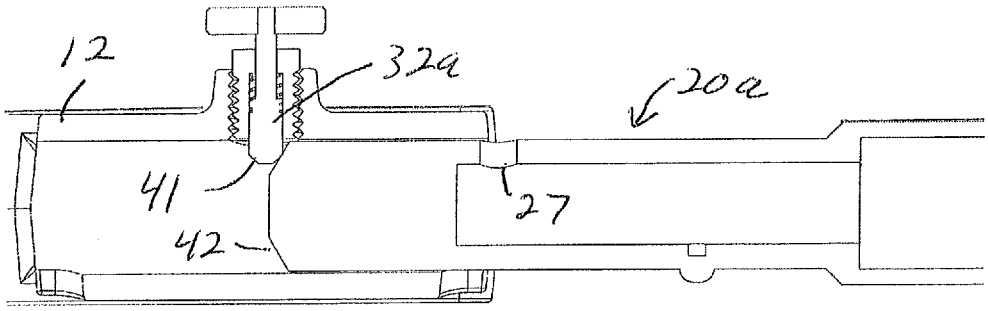
FIGS. 9A and 9B are longitudinal cross-sectional views of the revised pull pin and pull pin-engaged handle of FIGS. 6-8, with the handle being inserted into the socket.
Figure 9B:
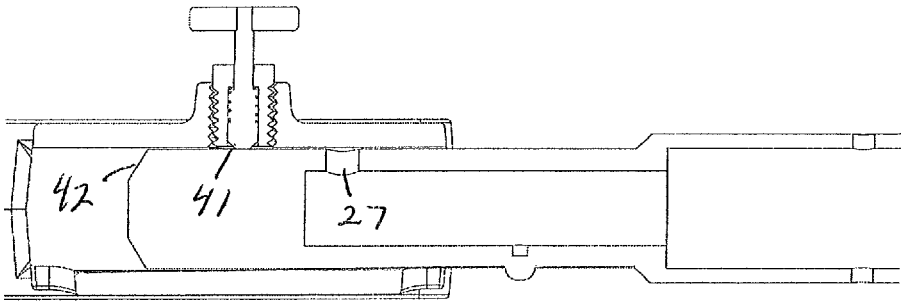

FIGS. 6, 7A, 7B, 8A and 8B are very similar to FIGS. 2, 3A, 3B, 4A and 4B, respectively, but showing a revised pull pin and pull pin-engaged handle of a second example hoist 10*a*, while FIGS. 9A and 9B show the revised pull pin and pull pin-engaged handle of second example hoist 10*a* in use. Pull pin assembly 30*a* differs from pull pin assembly 30 due to its tapered/chamfered tip 41 of pin 32*a*. Also, handle portion 26*a* differs from handle portion 26 due to its tapered/chamfered tip 42. These two tapers/chamfers allow the handle to be inserted without the need to lift the pin. As shown in FIGS. 9A and 9B, as handle 20*a* is being inserted into socket 12, tapered/chamfered handle end 42 will contact tapered/chamfered pin tip 41. The tapers/chamfers are arranged so as to put upward force on the pin. Continued insertion will force pin 32*a* upward far enough to allow handle 20*a* to be further inserted as shown in FIG. 9B. As in the first example, the spring will then push the pin into opening 27 when the pin and opening are aligned.

Although certain aspects and details are shown and described herein, it should be understood that the examples illustrate the invention but does not limit its scope. The claims define the scope of the invention.

What is claimed is:

1. A handle-engaging assembly for releasably engaging a winch hoist handle in a winch hoist, where the winch hoist comprises a frame with an integral handle-receiving socket that is adapted to receive the handle, comprising:

a pull pin assembly that comprises a spring-loaded pin that is constructed and arranged to be manipulated such that it engages with or disengages from an opening in the handle; and a fixed projection on the handle that is received in the socket, and a mating receiving recess in the socket that receives the fixed projection when the handle is in proper rotational alignment and has been fully inserted into the socket.

2. The assembly of claim 1, wherein the pull pin assembly pin is captured within an externally threaded insert that is threaded into and captured within a threaded receptacle that is mounted in the handle socket.

3. The assembly of claim 1, wherein the pin is aligned with the opening in the handle when the handle is properly rotationally aligned with and fully inserted into the socket.

4. The assembly of claim 1, wherein the pull pin assembly includes a cavity in which a coil spring is located, where the spring is constructed and arranged to push the pin into the opening in the handle.

5. The assembly of claim 1, wherein the pin has a tapered or chamfered end.

6. The assembly of claim 1, wherein the handle has a tapered or chamfered end.

7. A handle-engaging assembly for releasably engaging a winch hoist handle in a winch hoist, where the winch hoist comprises a frame with an integral handle-receiving socket that is adapted to receive the handle, comprising:

a pull pin assembly that comprises a spring-loaded pin that is constructed and arranged to be manipulated such that it engages with or disengages from an opening in the handle, wherein:

the pull pin assembly pin is captured within an externally threaded insert that is threaded into and captured within a threaded receptacle that is mounted in the handle socket;

the pin is aligned with the opening in the handle when the handle is properly rotationally aligned with and fully inserted into the socket; and the pull pin assembly further comprises a cavity in which a coil spring is located, where the spring is constructed and arranged to push the pin into the opening in the handle; and a fixed projection on the handle that is received in the socket, and a mating receiving recess in the socket that receives the fixed projection when the handle is in proper rotational alignment and has been fully inserted into the socket.

8. The assembly of claim 7, wherein the pin has a tapered or chamfered end.

9. The assembly of claim 7, wherein the handle has a tapered or chamfered end.

10. A handle-engaging assembly for releasably engaging a winch hoist handle in a winch hoist, where the winch hoist comprises a frame with an integral handle-receiving socket that is adapted to receive the handle, comprising:

a pull pin assembly that comprises a spring-loaded pin that is constructed and arranged to be manipulated such that it engages with or disengages from an opening in the handle, wherein:

the pull pin assembly pin is captured within an externally threaded insert that is threaded into and captured within a threaded receptacle that is mounted in the handle socket;

the pin is aligned with the opening in the handle when the handle is properly rotationally aligned with and fully inserted into the socket;

the pull pin assembly further comprises a cavity in which a coil spring is located, where the spring is constructed and arranged to push the pin into the opening in the handle;

the pin has a tapered or chamfered end;

the handle has a tapered or chamfered end; and a fixed projection on the handle that is received in the socket, and a mating receiving recess in the socket that receives the fixed projection when the handle is in proper rotational alignment and has been fully inserted into the socket.

* * * * *